United States Patent [19]

Pissot

[11] Patent Number: 4,496,177

[45] Date of Patent: Jan. 29, 1985

[54] LATCH FOR THE CLOSURE PANEL OF A UNIT SUCH AS A CASSETTE READER AND A UNIT FITTED WITH SAID LATCH

[75] Inventor: Guy Pissot, Paris, France

[73] Assignee: Thomson-Brandt, Paris, France

[21] Appl. No.: 391,991

[22] Filed: Jun. 25, 1982

[30] Foreign Application Priority Data

Jun. 26, 1981 [FR] France ..... 81 12609

[51] Int. Cl.[3] ..... E05C 19/18

[52] U.S. Cl. ..... 292/87; 292/288; 292/DIG. 38

[58] Field of Search ..... 292/80–90, 292/202, DIG. 38, 288, 258

[56] References Cited

U.S. PATENT DOCUMENTS 406,173 7/1889 Lipe ..... 292/80
2,504,204 4/1950 Kiefer ..... 292/87 X
2,803,476 8/1957 Ivanhoe ..... 292/80
3,822,905 7/1974 Bell ..... 292/87
3,841,518 10/1974 Hines ..... 292/80 X

FOREIGN PATENT DOCUMENTS 1056999 2/1967 United Kingdom .

*Primary Examiner*—Richard E. Moore
*Attorney, Agent, or Firm*—Oblon, Fisher, Spivak, McClelland & Maier

[57] ABSTRACT

The latch body comprises a rectangular head-plate to which is attached a perpendicular frame. A flexible U-shaped strip extending from the base member of the frame is joined to or integral with a latch arm, the free end of which is provided with a locking lug. Operation of the latch is performed by introduction of the frame and latch arm within a locking recess of the unit and snap-action engagement of the locking lug beneath a shoulder of the recess.

11 Claims, 3 Drawing Figures

LATCH FOR THE CLOSURE PANEL OF A UNIT SUCH AS A CASSETTE READER AND A UNIT FITTED WITH SAID LATCH

This invention relates to a latch for the closure panel or cover of a unit such as a cassette reader and to a unit fitted with a latch of this type.

Since cassette readers are mass-produced devices, it is a desirable objective to ensure that their different components are not only simple and inexpensive to produce but also provide reliable and satisfactory operation while being easy to handle and to replace.

Latches for locking and unlocking cassette-reader covers which are usually provided with a cassette compartment and thus form cassette loading and unloading magazines have failed up to the present time to satisfy all these conditions.

The present invention overcomes the disadvantages mentioned in the foregoing.

The latch according to the invention comprises an arm attachable to the unit and a flexible connecting member for joining said arm to the latch body, said latch being actuated by flexural deformation of the connecting member. The distinctive feature of the latch lies in the fact that the latch arm is attached by snap-action engagement in the unit, introduction of the latch arm within its housing being also made possible by the flexural deformation of said connecting member. A latch constructed in accordance with these arrangements wholly satisfies all the conditions noted earlier.

The latch body, the latch arm and the flexible connecting member are preferably designed to form a single piece which can be made of plastic material in particular.

In one embodiment of the invention, the latch body comprises an actuating and locking head in the form of a simple rectangular plate, a frame disposed at right angles to said head and a latch arm flexibly attached to the base of said frame, said arm being substantially parallel to the plane of said frame. In this case the latch arm itself can be flexible.

Other features of the invention will be more apparent upon consideration of the following description and accompanying drawings, wherein.

Figure 2:
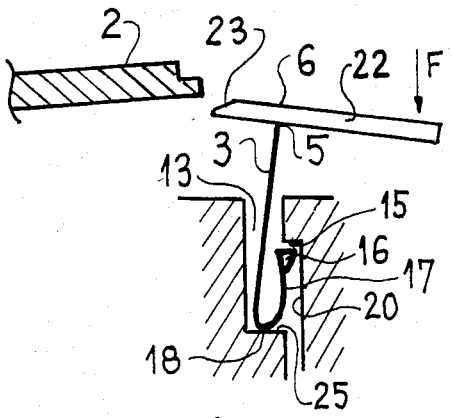
FIG. 2 is a view which is similar to FIG. 1 but in the open position.

The latch 1 is intended to lock the cover 2 of a cassette reader-recorder unit in the closed position. In accordance with known practice, a unit of this type is provided with a compartment (not shown in the drawings) for a cassette and thus forms a cassette loading and unloading device. When the latch 1 is released from the cover 2 (as shown in FIG. 2), said cover 2 is returned automatically to its open position by means of springs (which have also been omitted from the drawings).

The latch 1 is of single-piece construction and of plastic material.

Figure 3:
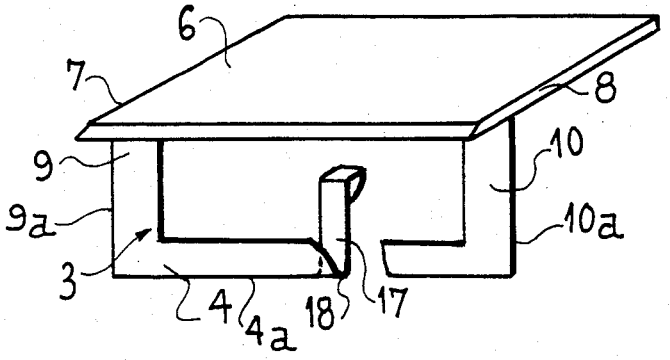
FIG. 3 is a schematic view in perspective showing the latch according to the invention.

The latch comprises a rigid body having a U-shaped frame 3 (as shown in FIG. 3) with a horizontal base 4 of substantial length and two vertical upright members 9 and 10 which are attached to the head 6 along their top edges 5. Said head 6 is a rectangular plate, the plane of which is perpendicular to the plane of the frame 3 and the thickness of which is at least equal to the thickness of the frame. The length of the head 6 in a direction parallel to the horizontal base 4 is substantially the same as the length of the frame 3, its short sides 7 and 8 being opposite to the short vertical sides $9_a$ and $10_a$ respectively of the frame 3.

The top edge 5 which is common to the upright members 9 and 10 and to the head 6 is nearer the front edge 11 of the head (or in other words nearer the edge adjacent to the cover 2) than the rear edge 12.

A substantial portion of the frame 3 is placed within a recess 13 provided in the unit in the vicinity of the free edge 14 of the cover 2.

Said recess 13 has a downwardly-directed shoulder 15 forming a stop for a projecting lug 16 formed at the end of a latch arm 17 which is parallel to the frame 3, said arm being joined to the bottom edge $4_a$ of the base 4 of said frame by means of a flexible strip 18 having the shape of a circular arc. The width of the latch arm 17 is distinctly smaller than the length of the side 4. Said arm 17 is located in the central region of the side 4 (as shown in FIG. 3) and is flexible in the example under consideration, as in the case of the arcuate connecting strip 18.

The latch arm 17 and its connecting strip 18 serve on the one hand to actuate the latch and on the other hand to attach the latch to the unit by snap-action engagement.

Thus in order to introduce the frame 3 within the recess 13, the latch arm 17 is moved towards said frame 3 and then, when the lug 16 has moved into position below the shoulder 15, said arm 17 is permitted by the elasticity of the plastic material to return of its own accord to a position in which it is parallel to the frame 3. Said frame can then no longer escape from the recess 13 by reason of the fact that the top edge of the lug 16 is abuttingly applied against the shoulder 15.

In order to remove the frame 3 and the latch arm 17 from their recess with a view to replacing the latch, for example, provision is made for a hole 19 which opens into the lower end of the recess 13 near the arm 17. Said hole permits introduction of a tool such as a screwdriver in order to thrust the arm 17 towards the frame 3 and thus to disengage the lug 16 from the shoulder 15.

Figure 1:
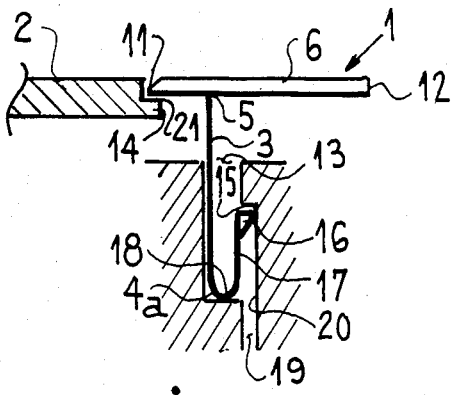
FIG. 1 is a sectional diagram of a latch and of part of the unit according to the invention in the closed position of the panel.

In the rest position or in other words when no action is exerted on the latch 1, the latch arm 17 is parallel to the plane of the frame 3 (as shown in FIG. 1) and the projecting lug 16 is applied against the rear wall 20 of the recess 13.

The cover 2 is provided on its free edge 14 with a shoulder 21, the front end of the head 6 being intended to be applied against said shoulder.

In order to release the latch, the head 6 is pressed downwards or, in other words, a downwardly-directed vertical force F is exerted at any point of the zone 22 of said head 6, namely in the rear portion of the head with respect to the frame 3. The latch body accordingly undergoes a pivotal displacement about an axis corresponding to the bottom edge $4_a$ of the base of the frame 3 by virtue of the flexural deformation of the arcuate strip 18 and also of the latch arm 17 if so required. In this position (shown in FIG. 2), the projecting lug 16 is applied against the rear wall 20 of the recess 13 and the connecting strip 18 is applied against the bottom end-wall 25 of said recess. The front portion of the head 6 is then completely disengaged from the cover 2.

The front portion of the head 6 is provided with a chamfered edge 23 providing an upwardly-directed end face which enables the latch to undergo a rearward pivotal displacement and therefore to withdraw when the cover 2 is moved from the open position to the closed position.

What is claimed is:

1. A cassette reader unit having a unit body, a closure panel and a latch for said closure panel, wherein said latch comprises:

a locking head;

a latch body attached to said locking head;

an arm attached to said latch body and including snap action engagement means for retaining said arm in a recess of said unit body; and a flexible connecting member joining said arm to said latch body; and wherein said connecting member is constructed such that flexural deformation of said connecting member permits the pivoting of the latch body for the operation of the latch and permits the introduction of a part of said latch body, said connecting member and the arm in said recess of said unit body.

2. A unit according to claim 1, wherein said snap action engagement means includes a projecting lug and said locking recess includes a shoulder cooperating with said lug for retaining said arm in said recess.

3. A unit according to claim 1 wherein said arm is flexible.

4. A unit according to claim 1, wherein said latch arm, the connecting member and the latch body are of one piece construction and are formed of plastic material.

5. A unit according to claim 1, wherein the latch body comprises a flat frame with a bottom edge to which is attached said connecting member, and wherein said arm extends parallel to the plane of said frame.

6. A unit according to claim 5, wherein said latch body and latch arm are located above said flexible connecting member.

7. A unit according to claim 5, wherein the latch arm is attached to the bottom edge of the frame at a mid-portion of said bottom edge of said frame.

8. A unit according to claim 5, wherein the frame has the general shape of a U with a horizontal base member and two vertical upright members.

9. A unit according to claim 5, wherein said locking head is rigidly fixed to a top edge of the frame.

10. The unit according to claim 9 wherein said locking head has a front portion adapted to engage said closure panel for locking said closure panel, wherein said locking head has a rear portion adapted for manual engagement, and wherein said frame is fixed to said locking head adjacent said front portion, whereby a manual force on said rear portion pivots said locking head due to flexibility of said connecting member to open said closure panel.

11. A unit according to claim 10, wherein a hole opens into said recess, said hole being constructed such that a tool can be introduced in said hole for displacing said latch arm which is locked in position by said shoulder and thus permitting withdrawal of said latch from said recess.

* * * * *